US007152953B2

(12) United States Patent
Haan et al.

(10) Patent No.: US 7,152,953 B2
(45) Date of Patent: Dec. 26, 2006

(54) INK TANK AND MOUNTING SOCKET

(75) Inventors: Maurice Johan Jozef Haan, Landgraaf (NL); Mark Pieter Jozef Pinckaers, Venlo (NL)

(73) Assignee: Oce Technologies B.V., Venlo (NL)

( * ) Notice: Subject to any disclaimer, the term of this patent is extended or adjusted under 35 U.S.C. 154(b) by 167 days.

(21) Appl. No.: 10/664,168

(22) Filed: Sep. 17, 2003

(65) Prior Publication Data

US 2004/0055487 A1 Mar. 25, 2004

(30) Foreign Application Priority Data

Sep. 20, 2002 (EP) ..... 02079185

(51) Int. Cl.
*B41J 2/14* (2006.01)
*B41J 29/393* (2006.01)
*B41J 2/175* (2006.01)

(52) U.S. Cl. ..... 347/49; 347/19; 347/86

(58) Field of Classification Search ..... 347/19, 347/49, 85, 86, 87
See application file for complete search history.

(56) References Cited

U.S. PATENT DOCUMENTS 4,838,804 A * 6/1989 Banjo et al. ..... 439/325
5,049,898 A * 9/1991 Arthur et al. ..... 347/19
5,861,897 A 1/1999 Tsutomu et al.
6,196,670 B1 * 3/2001 Saruta ..... 347/86
6,227,638 B1 * 5/2001 Childers et al. ..... 347/7
6,375,298 B1 * 4/2002 Purcell et al. ..... 347/14
6,375,315 B1 * 4/2002 Steinmetz et al. ..... 347/86
6,406,120 B1 * 6/2002 Pauschinger ..... 347/19
6,488,369 B1 * 12/2002 Steinmetz et al. ..... 347/86

FOREIGN PATENT DOCUMENTS

EP 0 860 284 A 8/1998
EP 1 208 986 A 5/2002

* cited by examiner

*Primary Examiner*—Anh T. N. Vo
(74) *Attorney, Agent, or Firm*—Birch, Stewart, Kolasch, and Birch LLP

(57) ABSTRACT

An ink tank for an ink jet printer containing an electronic memory device for storing information on the contents of the ink tank, wherein the ink tank has an elongated casing having one end adapted to be inserted into a mounting socket of the ink jet printer in an essentially horizontal direction, and the electronic memory device is configured as a button provided on a bottom side of the casing so as to engage an electric contact of the mounting socket under the weight of the ink tank.

8 Claims, 2 Drawing Sheets

INK TANK AND MOUNTING SOCKET

BACKGROUND OF THE INVENTION

This non-provisional application claims priority under 35 U.S.C. § 119(a) on Patent Application No. 02079185.1 filed in Europe on Sep. 20, 2002, which is herein incorporated by reference.

FIELD OF THE INVENTION

The present invention relates to an ink tank for an ink jet printer, wherein the ink tank has an electronic memory for storing information on the contents of the ink tank. The present invention further relates to a mounting socket for the ink tank.

RELATED ART

An ink tank of the type described above has been disclosed in EP-A-1 208 986. This known ink tank is adapted to be plugged into a mounting socket of an ink jet printer from above, so that the ink tank is fluidly connected with the print head of the printer. A memory chip storing information of the ink contained in the ink tank, e.g. the type and color of the ink, the filling date, the optimal operating temperature and the like, is provided at a side wall of the ink tank and has electric contacts which mate with corresponding contacts of a reading head provided on the side of the mounting socket. Thus, when the ink tank is fitted into the mounting socket, a plug-type electrical connection is formed between the memory chip and the reading head, so that the information stored in the memory can be read out and can be used for adjusting the printing parameters of the printer. In order to obtain a reliable electric contact between the memory chip and the reading head, it is necessary that the ink tank is precisely and tightly fitted into the mounting socket. Due to distortions of the walls of the ink tank, which must be expected in the case of an ink tank which has a relatively large volume, it may be difficult to insert the ink tank into the mounting socket and/or to obtain a reliable electrical contact.

SUMMARY OF THE INVENTION

It is accordingly an object of the present invention to provide an ink tank which can easily be fitted into the mounting socket of the printer and nevertheless assures a reliable electrical contact between the electronic memory of the ink tank and the circuitry of the printer.

The ink tank of the present invention has an elongated casing having one end adapted to be inserted into a mounting socket of an ink jet printer in an essentially horizontal direction, and the memory is configured as a button provided on a bottom side of the casing so as to engage in electrical contact with the mounting socket under the weight of the ink tank.

Thus, the weight of the ink tank and the ink contained therein is used for providing sufficient contact pressure between the memory button and at least one of the electrical contacts of the mounting socket. As a result, a reliable electrical connection may be established even when comparatively large manufacturing tolerances are admitted for the mounting socket of the printer and the end of the ink tank cooperating therewith. Since it is no longer necessary to provide for a tight fit between the ink tank and the mounting socket, the operation of inserting the ink tank into the mounting socket is facilitated.

It will be understood that it is sufficient to read out the contents of the memory at the time when a new ink tank which is completely filled with ink is fitted into the mounting socket for the first time. Under these conditions, the ink tank is at its maximum weight, so that a good electrical contact is assured.

The present invention further has the advantage that the memory button may easily be fitted to the casing of the ink tank without having to observe narrow positional tolerances.

Preferably, the ink tank has a coupling member for fluidly connecting the interior of the ink tank to an ink supply line of the printer, and this coupling is formed in an end wall at the end of the casing which is adapted to be fitted into the mounting socket. When the ink tank is thrust into the mounting socket in an essentially horizontal direction, the coupling member of the ink tank will engage with a mating coupling member of the mounting socket and will be held in engagement therewith preferably by a snap-action connection. When the coupling is engaged, the memory button has reached a position right above the contacts of the mounting socket and is pressed against these contacts due to the weight of the ink tank.

Since the bottom is provided near the end of the elongated ink tank which is fitted into the mounting socket, a leverage effect is achieved which assists in establishing a good electrical contact.

The memory button is preferably fitted from outside into a mounting recess formed in the bottom wall of the casing and is preferably held in the mounting recess by press-fitting.

In a preferred embodiment, the memory button has a cylindrical casing having a cylindrical wall and a bottom wall which are both made of electrically conductive material and are electrically insulated from one another, so as to form at least two separate electrical contacts which are engaged by corresponding contacts in the mounting socket. One of these contacts, e.g. the one formed by the circumferential wall, may serve as a ground contact, whereas the other contact serves as a serial input and output port of the memory and at the same time as a power supply for the electronic memory.

Preferably, the mounting socket has at least two spring contacts, e.g. leaf springs, arranged to cooperate with the circumferential wall and the bottom wall, respectively, of the memory button. These spring contacts may comprise an upwardly biased contact for engaging the bottom wall of the memory button and two diametrically opposed lateral spring contacts engaging the circumferential wall of the button. The lateral spring contacts may, at the same time, serve as aligning means for aligning the coupling member of the ink tank with the mating coupling member of the mounting socket.

In an alternative embodiment which is preferable when the couplings of the ink tank and the mounting socket are held together by snap-action, the spring contacts of the mounting socket may comprise an upwardly biased contact and a contact which engages the circumferential wall of the button and is biased in a direction opposite to the direction in which the ink tank is inserted into the mounting socket. This spring contact will be deflected when the coupling member of the ink tank is snap-fastened to the mating coupling member of the mounting socket, and it will then be held in firm engagement with the memory button. When the ink tank is withdrawn, this spring contact will help to overcome the snap action of the coupling members.

The mounting socket and the casing of the ink tank are preferably formed with cooperating upper and lower supports which bear the torque exerted by the weight of the ink tank and prevent the fluid coupling and the spring contacts from being overloaded.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
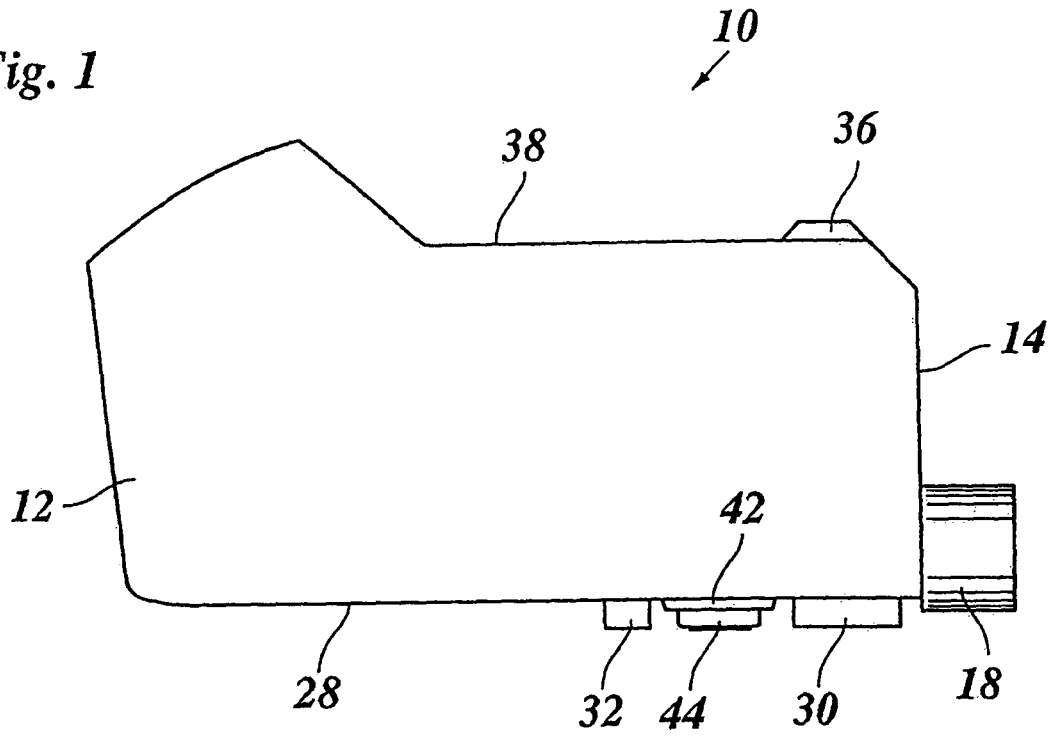
FIG. 1 is a side view of an ink tank according to the present invention.

As is shown in FIG. 1, an ink tank 10 for an ink jet printer comprises an elongated casing 12 made of molded plastic and having a front end 14 delimited by an essentially vertical end wall. The front end of the ink tank 10 is adapted to be inserted in an essentially horizontal movement (from left to right in FIG. 1) into a mounting socket 16 which is shown in FIG. 2 and which is provided on a machine frame (not shown) of the ink jet printer.

The ink tank 10 has a coupling member 18 projecting from the front end wall near the bottom of the casing 12. When the ink tank is inserted into the mounting socket 16, the coupling member 18 engages with a mating coupling member 20 so as to establish a fluid connection between the interior of the ink tank 10 and an ink supply line 22 of the printer. As is generally known in the art, the coupling members 18, 20 are held together by snap-action in the engaged condition and are of the self-sealing type, so that the volume in the ink tank 10 accommodating the liquid ink is sealed automatically when the coupling is disengaged.

Figure 2:
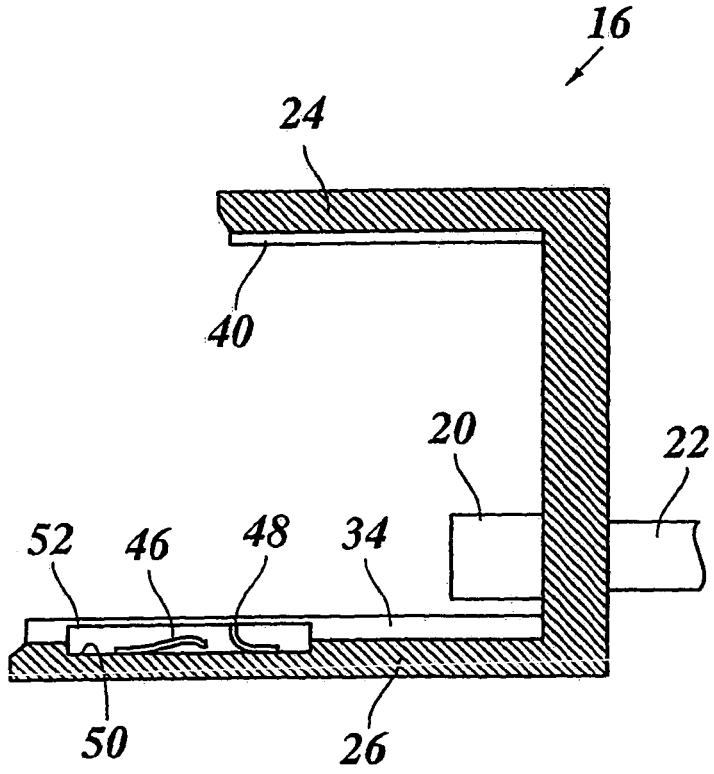
FIG. 2 is a longitudinal cross-section of a mounting socket for the ink tank shown in FIG. 1.

As is shown in FIG. 2, the mounting socket 16 has an essentially C-shaped configuration comprising an upper support arm 24 and a lower support arm 26 for the ink tank 10. The lower support arm 26 is shorter than the casing 12, so that the casing, when inserted into the mounting socket 16, is held in a cantilever fashion, and the tilting moment produced by the weight of the ink tank is absorbed by the upper and lower support arms 24, 26 of the mounting socket.

The bottom wall 28 of the casing 12 has two pairs of downwardly projecting and longitudinally extending guide ribs 30, 32 which cooperate with corresponding guide ribs 34 on the lower support arm 26. Similarly, a pair of guide ribs 36 is formed on the top wall 38 of the casing 12 adjacent the front end 14. These guide ribs 36 cooperate with guide ribs 40 on the bottom side of the upper support arm 24. Together, the guide ribs 30, 32, 34, 36 and 40 help to align the coupling members 18, 20 with one another, so that the coupling members may smoothly be fitted together.

The bottom wall 28 of the casing 12 is further formed with an annular boss which defines a downwardly open mounting recess 42 into which an electronic memory button 44 has been inserted. The memory button 44 is located on a longitudinal median plane of the casing 12 in a position between the pairs of guide ribs 30, 32, i.e. near the front end 14 of the casing 12.

As is shown in FIG. 2, the lower support arm 26 of the mounting socket 16 has two contact springs 46, 48 which are formed by leaf springs and are accommodated in a recess 50 on the top side of the support arm 26. The recess 50 is delimited by a pair of longitudinal guide ribs 52 for the memory button 44.

Figure 3:
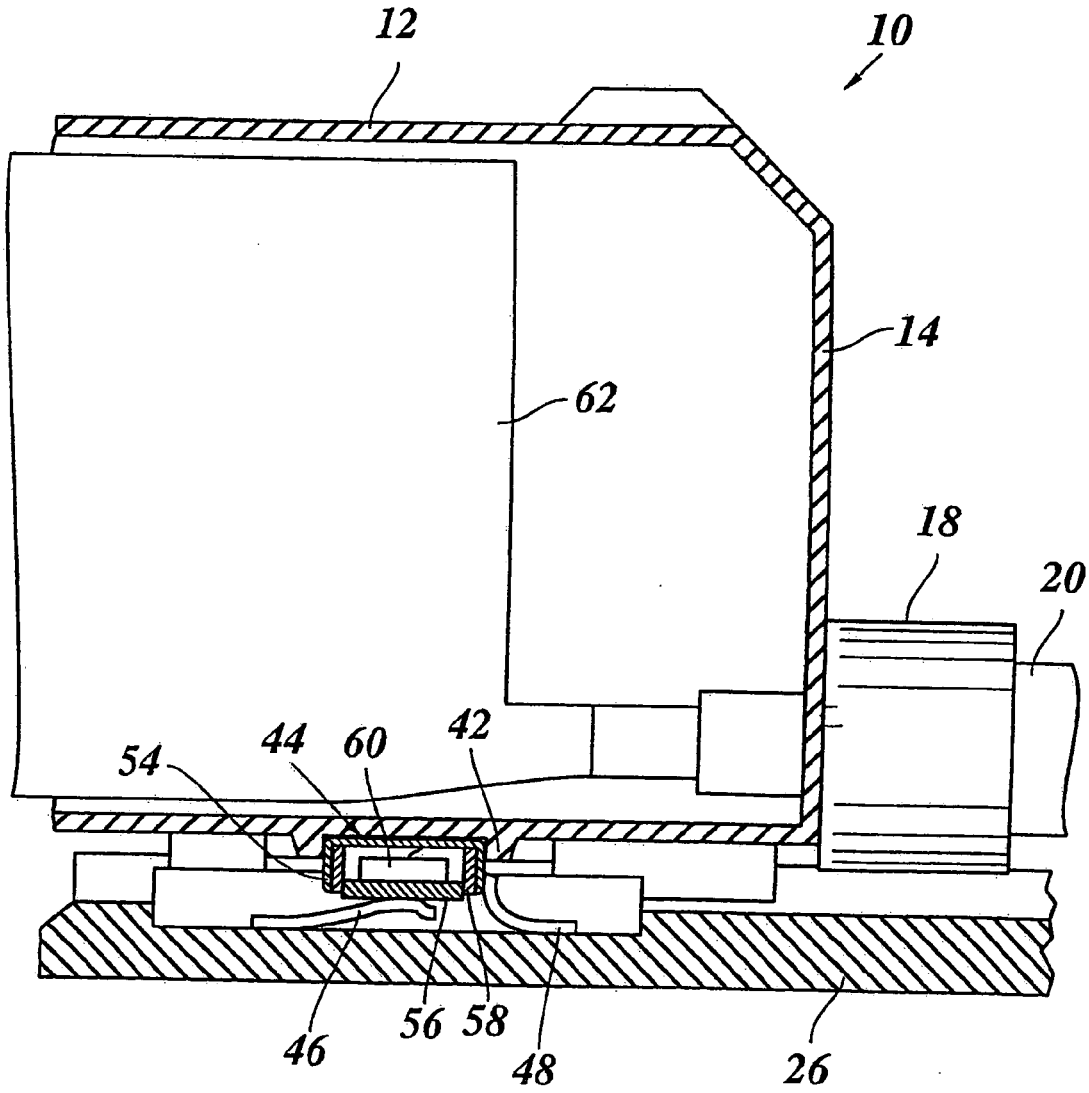
FIG. 3 is an enlarged cross-sectional view of parts of the ink tank and the mounting socket in engagement with one another.

As is shown in FIG. 3, when the ink tank 10 is inserted into the mounting socket so that the coupling members 18, 20 are engaged with one another and are held together by snap-action, the memory button 44 is held in a position right above the spring contact 46. The button 44 has a flat cylindrical casing comprising a circumferential wall 54 and a bottom wall 56 which are both made of metal but are electrically insulated from one another by an insulating sleeve 58. This casing accommodates an electronic memory device 60 which is electrically connected to both the circumferential wall 54 and the bottom wall 56 of the casing.

The spring contact 46 is upwardly biased against the bottom wall 56 of the button 44, so that the weight and tilting moment of the ink tank 10 contributes to the contact pressure between the spring contact 46 and the bottom wall 56.

The other spring contact 48 is biased against the circumferential wall 54 of the button 44 in a direction opposite to the direction in which the coupling members 18, 20 are engaged with one another. However, the force of the spring contact 48 is not strong enough to overcome the snap action which holds the coupling members 18 and 20 together.

In this way, the spring contacts 46 and 48 establish a reliable electrical contact between the memory device 60 and the circuitry (not shown) of the printer, to which the spring contacts 46 and 48 are connected.

When the ink tank has been thrust into the mounting socket 16 and the electrical contact between the memory device 60 and the circuitry of the printer has been established, the information stored in the memory device 60, e.g. information on the type and color of ink contained in the ink tank 10, the date when the ink tank has been filled with ink, the optimal operating temperature of the ink for printing, and the like, will be read out from the memory device 60 via the spring contacts 46 and 48, so that the settings of the printer can automatically be adapted to the properties of the ink.

As can further be seen in FIG. 3, the casing 12 accommodates a flexible and collapsible bag 62 which contains the liquid ink and is fluidly connected to the coupling member 18 and hence to the supply line 22 of the printer. As a result, once the connection between the coupling members 18 and 20 has been established, the ink contained in the bag 62 may flow out under the influence of gravity.

When the bag 62 becomes empty, the ink tank 10 may easily be removed and replaced by a new one. Of course, when the empty tank is to be refilled, a contact arrangement similar to that shown in FIG. 3 may be used for getting access to the memory device 60 and for updating, the contents thereof.

It is understood that the spring contacts 46 and 48 can have a different shape. Also, leaf spring 48 can be formed with two leaf springs positioned such that the circumferential wall 54 slides between these springs and contact these springs at a position where these springs are more closely together.

When more pressure is needed for an optimal contact of the button, some extra force could be exerted on the upper side of the ink tank e.g. by means of an extra leaf spring with some gliding means at the contacting position. A rotating wheel with some pressure could also be used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink tank assembly for an ink jet printer, which comprises an ink tank containing an electronic memory device for storing information on the contents of the ink tank, said ink tank including an elongated casing having one end thereof adapted to be inserted into a mounting socket of the ink jet printer in an essentially horizontal direction, said electronic memory device being provided on a bottom side of the casing and configured to electrically engage the mounting socket under the weight of the ink tank and ink contained therein, said electronic memory device being configured as a button which is located near said one end of the casing.

2. The ink tank according to claim 1, further comprising a coupling member extending from said one end of the casing and adapted to engage a coupling member of the mounting socket so as to fluidly connect the interior of the ink tank with the ink supply system of the printer.

3. The ink tank according to claim 1, wherein the electronic memory device is held in a mounting recess formed on the outside of a bottom wall of the casing.

4. The ink tank according to claim 1, wherein the button has a casing comprising a circumferential wall and a bottom wall which are both made of electrically conductive material but are electrically insulated from one another so as to form at least two electrical contacts.

5. A mounting socket adapted to receive and hold in an essentially horizontal direction an ink tank containing an electronic memory devices which comprises a support arm which is provided with a first upwardly biased spring contact which is adapted to engage the electronic memory device of the ink tank and a second spring contact which is adapted to engage a circumferential wall of the electronic memory device, said electronic memory device being configured as a button which is located at a bottom wall of said ink tank and near one end of an elongated casing of said ink tank.

6. The mounting socket according to claim 5, further comprising a coupling member adapted to be brought into engagement with a coupling member of the ink tank, said coupling members being held in engagement by snap-action, and wherein the second spring contact is biased against the circumferential wall of the electronic memory device in a direction opposite to the direction in which the coupling members are engaged.

7. The mounting socket according to claim 6, which is adapted to hold the ink tank in a cantilever fashion.

8. A mounted ink tank assembly which comprises:

an ink tank including an elongated casing having a bottom wall provided with an electronic memory device configured as a button located near one end of said casing and an end wall provided with a coupling member;

a mounting socket containing a mating coupling member which is adapted to engage the coupling member of the ink tank in substantially a horizontal direction, said mating coupling member also providing communication with an ink supply line, said mounting socket further containing contact springs which are adapted to provide electrical contact with the electronic memory device when the coupling member of the ink tank is operatively connected with the mating coupling member of the mounting socket, said electrical contact being facilitated to electrically engage with the electronic memory device by the weight of the ink tank and ink contained therein.

* * * * *